United States Patent [19]

Thoma

[11] 4,108,383

[45] Aug. 22, 1978

[54] FUEL INJECTION VALVE WITH STEPPED INJECTION

[75] Inventor: Frank Thoma, Stuttgart, Fed. Rep. of Germany

[73] Assignee: Daimler-Benz Aktiengesellschaft, Fed. Rep. of Germany

[21] Appl. No.: 662,421

[22] Filed: Mar. 1, 1976

[30] Foreign Application Priority Data

Mar. 1, 1975 [DE] Fed. Rep. of Germany ..... 2509068

[51] Int. Cl.$^2$ ..... B05B 1/32

[52] U.S. Cl. ..... 239/533.5

[58] Field of Search ..... 239/91, 96, 533.4, 533.5, 239/533.7, 533.9; 123 32 F;32 G;32 JV;32 JT;139 AT;139 AK

[56] References Cited

U.S. PATENT DOCUMENTS

| | | | |
|---|---|---|---|
| 2,173,813 | 9/1939 | Bischof | 123/32 G UX |
| 2,813,752 | 11/1957 | Pringham | 123/32 G UX |
| 3,391,871 | 7/1968 | Fleischer et al. | 123/32 G X |
| 3,394,891 | 7/1968 | Voit | 123/32 G X |
| 3,403,861 | 10/1968 | Eidtmann et al. | 239/533.5 |

FOREIGN PATENT DOCUMENTS

| | | | |
|---|---|---|---|
| 1,576,478 | 1/1970 | Fed. Rep. of Germany | 123/32 G |
| 1,284,687 | 12/1968 | Fed. Rep. of Germany | 123/32 G |
| 810,456 | 3/1959 | United Kingdom | 123/32 G |
| 1,235,501 | 6/1971 | United Kingdom | 123/32 G |

*Primary Examiner*—Carlton R. Croyle
*Assistant Examiner*—Michael Koczo, Jr.
*Attorney, Agent, or Firm*—Craig & Antonelli

[57] ABSTRACT

A fuel injection valve for internal combustion engines, especially for Diesel engines, which is equipped with a valve needle acted upon in the closing direction by a spring and in the opening direction by the pressure of the fed fuel, to which is coordinated a pressure space formed together with the valve housing and adapted to be closed off against the outside by the valve seat of the valve needle; at least one discharge opening is arranged downstream of the valve seat as viewed in the flow direction which represents a predetermined throttle resistance; the injection valve is additionally equipped with at least two pistons kinematically coupled with one another in one direction of movement whereby a pressure space is formed on each side of the pistons; the pistons, on the inlet side, are adapted to be acted upon at least indirectly by the pressure of the fed fuel and, on the outlet side, at least indirectly by a return spring; an unobstructed connection exists between the outlet side piston pressure space of at least one of the pistons with the pressure space of the valve needle while an unobstructed line connection exists from the space defined by a control edge and the pressure space of the valve needle; the outlet side pressure space of the main injection piston is connected with a reservoir by way of a line having a predetermined throttling effect.

34 Claims, 4 Drawing Figures

FIG 1
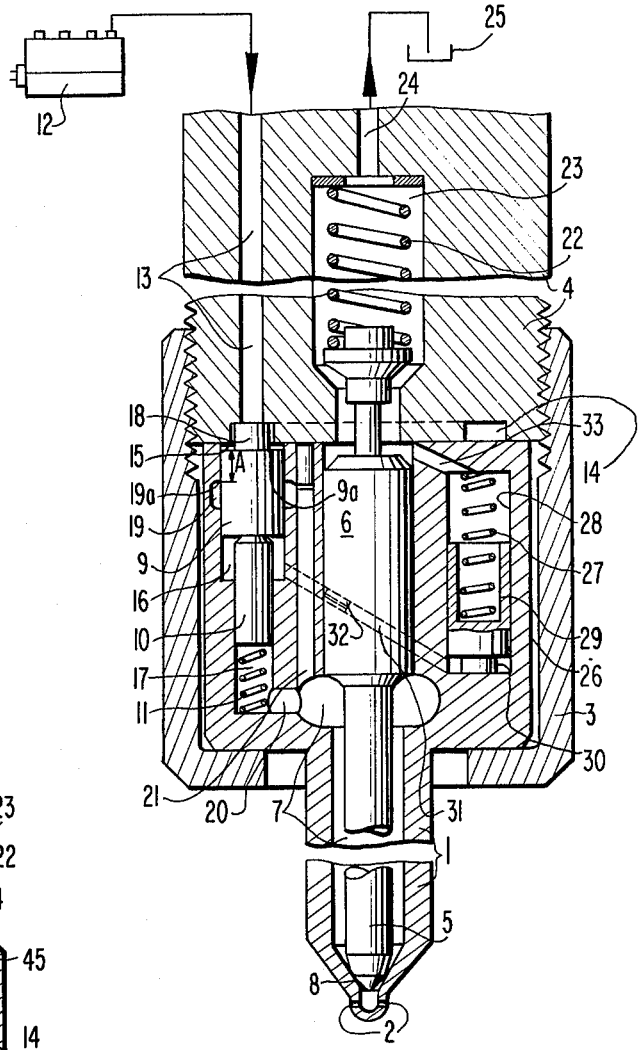
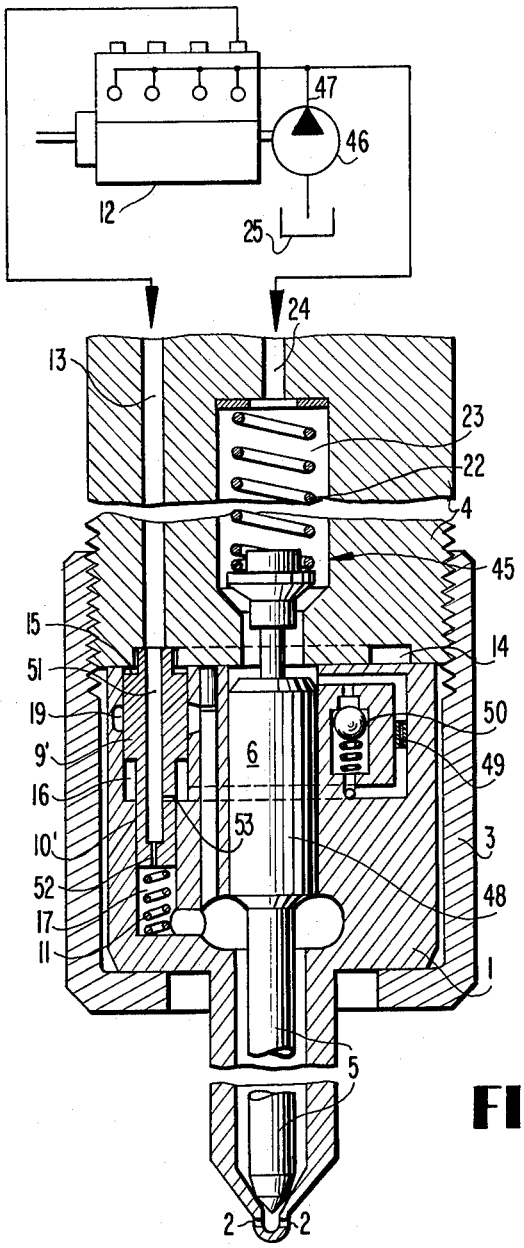
FIG 4

FUEL INJECTION VALVE WITH STEPPED INJECTION

The present invention relates to a fuel injection valve for internal combustion engines, especially for Diesel engines, with a valve needle or valve pin actuatable in the closing sense by a spring and in the opening sense by the pressure of the fed fuel, and with a pressure space which is coordinated to the valve needle formed together with the valve housing and adapted to be closed against the outside by the valve seat of the valve needle, whereby at least one discharge opening representing a definite throttle resistance is arranged downstream of the valve seat, as viewed in the flow direction, furthermore with at least two pistons coupled with one another kinematically at least in one direction of movement, which are preferably arranged pairwise coaxially to one another, which are reciprocable between two respectively defined axial positions, and more particularly between an inlet-side axial position and an outlet-side axial position, and which together with a piston slide surface and with a housing and possibly with an axially adjacent piston form one pressure space each on both sides of the piston, whereby the pistons are actuatable, on the one hand, and more particularly on the inlet-side, at least indirectly by the pressure of the fed fuel and, on the other hand, and more particularly on the outlet-side, also at least indirectly by a return spring, additionally with an unconstricted line connection of the outlet-side piston pressure space of at least of one of the pistons—pre-injection piston—with the pressure space of the valve needle and with a control edge at the remaining one of the pistons—main injection piston—which is axially spaced from the inlet-side axial position by a predetermined path (lead distance) and which is adapted to be overlapped or valved by the piston and defines the axial end of a housing hollow space open in the direction toward the piston slide surface, as well as with an unconstricted line connection of the housing hollow space or spaces located downstream of the control edge with the pressure space of the valve needle.

As is known, Diesel engines, in comparison to Otto engines, exhibit a relatively hard running operation at least in the partial load range, which stems from the fact that the fuel injected into the cylinder combustion space during the ignition delay period, combusts almost simultaneously after the commencement of the ignition. This simultaneous combustion stems from the fact that as a result of the pressure- and temperature-increase during the combustion of the fuel particles injected at first during the ignition delay period, the delay up to the combustion beginning of the subsequently injected fuel particles is reduced very strongly.

One has therefore attempted to influence the combustion progress in that one injects initially only a part of the injection quantity (pre-injection) and somewhat later the main portion (main injection) so that the injection quantity commences to burn or combust staggered with respect to time approximately corresponding to the injection principle and a somewhat softer running of the engine results correspondingly. In that connection, it was above all the aim to clearly set apart with respect to time the pre-injection from the main injection (compare, for example, German Offenlegungsshrift 1,576,478).

Investigations with a view toward the improvement of the exhaust gases have now demonstrated that a cause for the harmful components in the exhaust gases is a poor fuel atomization during the injection process. It has been found that during the opening and closing phases of the injection valve an atomization is very strongly impaired because the flow resistance through the valve gap which opens and closes is very large in comparison to the fully opened valve; the pressure difference required for a good atomization is used up in these starting and terminal phases for overcoming the flow resistance so that a good atomizing jet does not come into existence during these transition periods. Consequently, one should aim at running through the opening and closing phases as rapidly as possible and to reduce the number of these phases to the absolute required minimum, namely, to two, i.e., to opening only once and to closing only once. In contrast thereto, these critical phases were passed through four times with the pre-injection offset with respect to the main injection.

A type of injection avoiding passing four-times through the transition phases is the so-called stepped injection which differs from the aforementioned pre- and main-injection in that during the injection period one injects initially with a smaller quantity (starting step) and that without an interim valve closure one then injects with a larger quantity in a second stage of the injection period and the injection quantity corresponding to the required output is supplied during the second stage (main step).

Different prior art types of the stepped injection—as also those of the pre- and main-injection—operate with a reservoir or storage means which during the period of the starting step of the injection absorbs fuel. A force-control or pressure-control of the injection quantities is thereby undertaken. This means, the distribution of the quantity supplied by the injection pump to the valve needle or pin and to the reservoir or storage means takes place on the basis of different equilibrium positions of spring-loaded pistons or valves which are able to exert an influence on the injection flows.

It is basically disadvantageous in connection with this pressure control that the injection operations are optimal only at a predetermined velocity, however, that with a large deviation from the design velocity of the injection, larger deviations from the aimed-at optimum may occur.

It is the task of the present invention to provide an injection valve for a stepped injection, which independently of the quantities to be injected and of the occurring rotational speeds stays always close in its behavior to the rated or designed injection behavior. The present invention thereby starts with the aforementioned injection valve which can be deduced from the already mentioned German Offenlegungsschrift 1,576,478. It is proposed in accordance with the present invention as solution to the underlying problem that all pressure spaces of the main injection pistons located on the discharge or outlet side are each connected with a reservoir or storage device by way of a line (branch line) containing a predetermined throttle place (branch throttle).

By reason of the branch throttle in the branch line leading to the reservoir, a similar pressure resistance is simulated in the pressure space of the main injection piston as at the discharge opening of the injection valve itself. By reason of the mechanical coupling of the pre-injection piston and of the main injection piston, it will lead to a genuine volume distribution which is independent of any load- or rotational speed-dependent fluctuations.

It is appropriate for the rapid re-filling of the piston pressure space out of the reservoir if the reservoir is constructed as pressure reservoir. The quantity branched off during the injection can then be pushed back again by way of the branch throttle during the intervals between two successive injection operations with a high pressure drop which was stored in the reservoir. Such a pressure reservoir can be constructed, for example, as the pressure space of a spring-loaded displaceable piston sealingly guided in a bore. This type of pressure reservoir, however, requires accurately machined parts matched to one another within narrow tolerances which might affect unfavorably the manufacturing costs of the injection valve. In order to be able to save this manufacturing expenditure, the pressure reservoir may also be constructed as pressure-tight vessel or as a number of pressure-tight vessels of constant volume hydraulically connected with each other without constriction whose volume corresponds at least to $k$ times the oscillating volume of the outlet-side pressure spaces of the main injection piston or pistons, whereby $k$ is calculated from the reciprocal of the compressibility of the fuel liquid divided by the average pressure during the starting phase of the injection operation. The elasticity of the fuel liquid is utilized with this more simple construction of the pressure reservoir, similar as with the expansion or air chamber principle, however, without air or gas cushion. This liquid elasticity is admittedly very small (approximately to 6.7 pro mil per 100 atu each), as viewed from an absolute point of view; however, in connection with the pressures in question and the quantities to be handled per working cycle, the inherent elasticity of the liquid does not play a negligible role, and more particularly, a larger role than that of the structural part elasticities.

A pressurized or pressure-tight receiving space for the valve needle closure spring as well as a line connection for this space are provided in the customary injection valves; furthermore, normally the injection pumps for Diesel engines include a feed or booster pump sucking-in fuel out of the fuel tank for the rapid filling of the working spaces of the injection pump building up the injection pressure, properly speaking. The aforementioned spring space can be utilized for the purposes of the present invention as reservoir space; however, the line connection at the spring space is thereby to be connected with the pressure side of the booster pump. The pressure of the booster pump may be sufficient in order to return during the time intervals between two injection operations, the by-pass volume through the by-pass throttle into the piston pressure space. A complete closing-off of the spring space without relief line approximately in the sense of the aforementioned volume pressure reservoir is not permissive since the fluid elasticity would act in an uncontrollable manner as additional spring on the working piston of the valve needle. A filling of the outlet-side pressure space of the main injection piston can be accelerated thereby and can thus also be taken into consideration with respect to an operation at rapid injection sequences if a check valve closing in the direction toward the reservoir is arranged hydraulically in parallel to the branch throttle. The branch throttle may thereby be structurally combined with the check valve.

In order to oppose to the by-pass flow as much as possible the same flow resistance as to the quantity reaching the injection, provision may be made according to the present invention that the throttle effect of the branch throttle is approximately equal to that of the discharge aperture of the injection valve.

In order that the remaining pressure spaces of the pistons are able to assume again their starting position after termination of the injection operation in the time interval up to the next injection and in order that the piston pressure spaces are able to fill up again, provision is made according to the present invention that the oppositely disposed sides of the piston are connected with each other by a pressure equalization throttle. This pressure equalization throttle may be formed, for example, also by a corresponding dimensioning of the clearance (annular gap) between the piston and piston slide surface.

In order to be able to adjust the injection quantity during the starting step of the injection, provision is appropriately made according to the present invention that the inlet-side axial position of the main injection piston is constructed adjustable.

Accordingly, it is an object of the present invention to provide a fuel injection valve with stepped injection which avoids by simple means the aforementioned shortcomings and drawbacks encountered in the prior art.

Another object of the present invention resides in a fuel injection valve which optimizes atomization of the injected fuel to improve the operation and exhaust gas quality of the engine.

A further object of the present invention resides in a fuel injection valve which assures a good atomizing jet over most of the injection period.

Still another object of the present invention resides in an injection valve which reduces to a minimum the opening and closing phases of the injection pin.

A still further object of the present invention resides in an injection valve for a stepped fuel injection which remains in its behavior always close to the designed injection behavior independently of the quantities to be injected and the rotational speeds which occur.

Another object of the present invention resides in a fuel injection valve which makes possible a genuine volume distribution of the fuel independent of any load or rotational speed fluctuations.

A further object of the present invention resides in a fuel injection valve which permits a rapid refilling of the piston pressure space out of a reservoir to improve the injection operation.

A still further object of the present invention resides in a fuel injection valve which is relatively simple in construction and obviates the need for costly parts that have to be machined to close tolerances.

These and other objects, features and advantages of the present invention will become more apparent from the following description when taken in connection with the accompanying drawing which shows, for purposes of illustration only, several embodiments in accordance with the present invention, and wherein:

FIG. 1 is a longitudinal axial cross-sectional view through an injection valve according to the present invention with a pressure reservoir constructed as springily supported piston;

FIG. 4 is a longitudinal axial cross-sectional view through a still further modified embodiment of an injection valve in accordance with the present invention utilizing the spring chamber for the valve needle as pressure reservoir.

Figure 2:
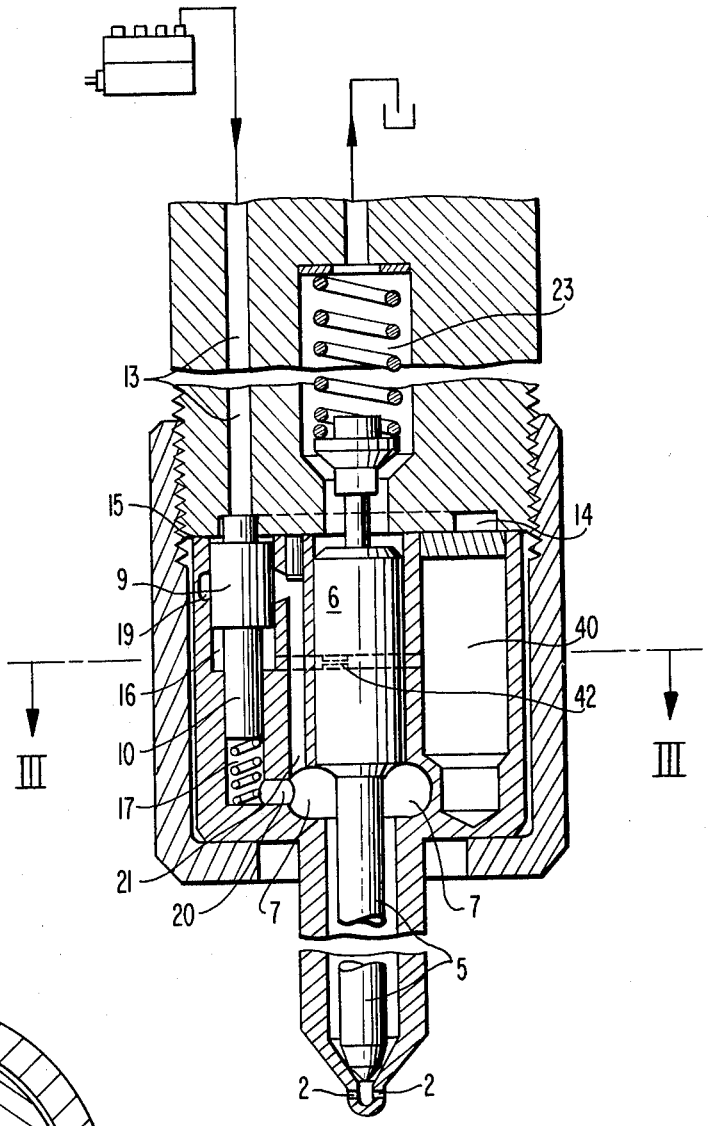
FIG. 2 is a longitudinal axial cross-sectional view through a modified embodiment of an injection valve in accordance with the present invention with a volume reservoir as pressure reservoir whose volume is non-yielding but very large compared to the oscillating component of the control piston.

Referring now to the drawing wherein like reference numerals are used throughout the various views to designate like parts, the various embodiments of the injection valves illustrated in the drawing, will at first be described to the extent that they correspond to one another. A nozzle body 1 with discharge openings 2 which represent a definite, predetermined flow resistance, is sealingly clamped to a nozzle support 4 by means of a clamping nut 3. A valve needle or pin 5 with a piston-like enlargement 6 is axially slidably supported in the nozzle body 1 within a coaxial accurately machined bore. The nozzle body 1 is provided at the transition place from the enlargement 6 into the needle part 5 with an annularly shaped pressure space 7 which represents the pressure space for the valve needle or pin 5. The valve needle 5 is constructed at its outermost end conically tapering and is being pressed with this conical surface against a corresponding counter surface at the nozzle body 1, whence a valve seat 8 comes into existence which is located upstream of the discharge openings 2, as viewed in the flow direction. The pressure space 7 of the valve needle 5 extends up to the valve seat 8.

A pair of control pistons 9 and 10 are arranged in parallel and adjacent to the valve needle piston 6 which are arranged coaxially to one another and by reason of their mutual abutment are necessarily coupled with each other. As will be explained more fully hereinafter, the smaller lower piston 10 is the pre-injection piston and the upper larger piston 9 is the main injection piston. The pistons 9 and 10 are displaced into the illustrated rest position by the spring 11. The spring 11 is relatively weak and serves exclusively for the return movements of the pistons 9 and 10 into the starting position during the period of time between two injection operations, but does not serve any control purposes. A pressure space is provided on each side of each piston. The pistons are actuatable with pressure from the injection line 13 coming from the injection pump 12 and from the annular channel 14. The upper side of the pistons 9 and 10 is the inlet side thereof. The pressure space 15 located above the main injection piston 9 is the inlet-side pressure space thereof. The pressure space located below the main injection piston 9 and simultaneously forming the space located above the lower pre-injection piston 10 is the outlet-side pressure space 16 of the main injection piston. Below the lower pre-injection piston is arranged the outlet-side pressure space 17 thereof.

The main injection piston 9 and together with the same the pre-injection piston 10 is determined in its upper extreme position by the location of the abutment pin 18 supported against the bottom of the annular channel 14, whereby the abutment pin 18 can be made to the requisite length by grinding or any other suitable after-machining operation. The upper boundary edge **9*a* of the main injection piston 9 is constructed with a definite shape and is arranged in the rest position thereof in a definite position by reason of the described abutment pin 18. An annular space 19 is exposed about the main injection piston 9—intersecting the cylindrical guide surface of the piston. The upper boundary edge 19*a* intersecting the guide surface of the piston forms a control edge corresponding with the upper piston edge 9*a***. The distance A of the control edges representing a lead distance is—as will be explained more fully hereinafter—the piston movement distance during the starting step of the injection.

The outlet-side pressure space 17 of the pre-injection piston 10 is in communication without constriction with the pressure space 7 of the valve needle 5/6 by way of the channel 20. Furthermore, also the annular space 19 is in unobstructed communication with the valve needle pressure space 7 by way of the flow connection 21. After traversing the lead distance A, when by reason of the opening of the two control edges **9*a* and 19*a* a direct connection exists between the inlet-side pressure space 15 and the annular space 19, an unobstructed connection is also established between the pressure space 15, i.e., between the injection line 13 and the valve needle pressure space 7 by way of the line 21 and the annular space 19**.

The valve needle 5/6 is prestressed in the closing direction by a spring 22. This spring 22 is arranged in a pressure-tight, sealingly closed-off space, the spring space 23. Since leakage oil of the piston 6 is unavoidably admitted into the spring space 23 and since this leakage oil is displaced on the backside of the piston during the lifting of the piston in the opening direction, the spring space 23 is hydraulically relieved or vented by way of a line connection 24. Normally, this relief connection—as is also the case in the embodiments according to FIGS. 1 and 2—is conducted pressureless into the fuel tank 25.

Insofar as the different embodiments were described so far, they are similar to one another. With respect to the following feature, there exists a correspondence exclusively in principle and in operation. This correspondence resides in the connection of the middle pressure space 16, i.e., of the outlet-side pressure space of the main injection piston 9 with the pressure reservoir by way of a branch line provided with a throttle (branch throttle).

In the embodiment according to FIG. 1, the pressure reservoir 26 is constructed in the form of a spring-loaded displaceable piston 29 spring-loaded by the spring 27 and slidable in a bore 28 constructed as piston slide surface. The spring 27 is relatively soft and serves exclusively for the timely return, however, not for control purposes. The piston 29 forms together with the bore 28 a pressure space 30 which is in communication by way of a branch line 31, in which is arranged a throttle 32, with the outlet-side pressure space 16 of the main injection piston 9. The throttle 32 is so constructed as regards its flow resistance that it is in that regard equivalent to the injection openings 2. The rear space of the pressure reservoir 26 receiving the spring 27 is hydraulically relieved into the spring space 23 by way of the line 33.

The operation of the injection valve according to the present invention as illustrated in FIG. 1 is now as follows:

It is assumed that by reason of a corresponding position of the parts of the injection pump 12, a pressure for an injection operation is just beginning to build up in the injection line 13. Consequently, with an increasing injection pressure—starting from the illustrated starting or rest position of the pistons 6, 9 and 10—the main injection piston 9 will start to move downwardly against the force of the spring 11. The main injection piston 9 thereby pushes the pre-injection piston 10 in front of itself and the pre-injection piston 10 displaces out of the outlet-side pressure space 17 a quantity corresponding to the piston stroke into the valve needle pressure space 7 whereby already at the beginning the valve needle 5 is lifted, and by way of the open valve seat 8 through the openings 2 into the cylinder work space (not shown) of a Diesel engine. Simultaneously therewith, the main injection piston 9 displaces out of its outlet-side pressure space 16 a quantity (branch quantity) corresponding to the piston stroke by way of the branch line 31 and by way of the branch throttle 32 mounted therein into the pressure space 30 of the pressure reservoir 26. By reason of the throttled discharge of the branch quantity a pressure of approximately the same magnitude (branch pressure) builds up in the pressure space 16 as in the outlet-side pressure space 17 of the pre-injection piston 10 which directly displaces the fuel through the injection openings 2 and is loaded with the flow resistance thereof (injection pressure during the starting step). As a result of the branch pressure built up in accordance with the present invention, it is simulated, so to speak of, to the main injection piston 10 that a quantity corresponding to the piston stroke times the entire area of the main injection piston is injected during the lead distance A; in reality, however, it is less. If the branch pressure were not to be built up in the space 16 but if the branch quantity could escape without obstruction, then the hydraulic force hydraulically acting on the inlet-side surface of the large main injection piston 9 could be transmitted non-reduced onto the smaller area of the pre-injection piston 10. The pistons 9 and 10 would therefore act as hydraulic translation or transmission with the consequence that the injection would take place with a higher pressure corresponding to the transmisssion ratio, i.e., more rapidly and with greater jet intensity. The lead distance A would then be traversed very rapidly and the main step of the injection would then adjoin immediately—with a non-translated injection pressure. Consequently, exactly the opposite would be achieved from what is being aimed at as such, namely, a temporary concentration of injection partial quantities at the injection beginning.

By reason of the construction according to the present invention of a branch counter-pressure, the hydraulic translation of the stepped or differential piston installation is throttled away, so to speak of. The injection pressure during the starting step of the injection is the same as that during the main step, with the difference that smaller quantities are injected. More particularly, the quantity injected in the starting step is equal to the quantity supplied during this period of time by the injection pump less the branched-off quantity. This interrelationship can be established without difficulty by reason of the strictly geometric quantity-branching and by reason of the equivalence and similar effect of the throttles building up pressure, namely, of the injection openings 2 and of the branch throttle 32. The aforementioned inter-relationship remains valid under all circumstances apart from negligible leakage quantities, i.e., with hot and with cold fuels (viscosity changes), at high or low injection sequences (rotational speed changes) and with large and with small injection quantities (load changes) since the conditions in all mentioned cases are always the same for both types of flow obstructions building up pressure during the starting step of the injection.

The described starting step of the injection is terminated when the main injection piston 9 has traversed the lead distance A. Since this distance A is constant and does not change, for example, in dependance on load or rotational speed and since furthermore the injection quantity is determined during the starting step exclusively by the piston stroke of the pre-injection piston 10, i.e., from the lead distance A, the partial injection quantity is always the same during the starting step. It may only lead at best to a more or less rapid termination of the starting step dependent on load and/or rotational speed. In every case, however, the starting step is also clearly distinguishable from the main step of the injection as regards quantity because according to the quantity equation indicated above, the quantity injected per unit time during the starting step—as explained—is in every case at least on the average lower by the branched off quantity than during the main step.

At the end of the lead distance A, the control edges **9*a* and 19*a* open and establish a connection between the inlet-side pressure space 15 of the main injection piston 9 and the annular space 19 so that an unobstructed flow connection is established from the injection line 13 by way of the spaces and lines 15, 19, 21 to the valve needle pressure space 7. Since all of these spaces were under the injection pressure already toward the end of the starting step and since the injection pressure in the main step continues to exist at the same magnitude, no pressure interruption will occur and, accordingly, no interruption of the injection will take place. To the extent of the opening of the control edges 9*a* and 19*a*, a transition toward larger injection quantities without significant pressure changes is continuously obtained. Toward the end of the feed stroke of the piston (not shown) of the injection pump 12 the pressure decrease commences in the system and the end of the injection. The injection velocity and accordingly the back-pressure built up as a result of the injection openings 2 in the valve needle pressure space 7 decrease. The closure spring 22 is able to displace the needle 5 and the piston 6** in the downward direction whence a certain oil volume of fuel liquid continues to be injected with decreasing injection pressure. Thereupon, the valve needle closes and the injection operation is terminated.

After the termination of the injection operation, the pre-injection piston 10 and the main injection piston 9 and the pessure reservoir piston 29 must return into the illustrated starting position. The return springs 11 and 27 serve this purpose. With four-cycle internal combustion engines, the period of time of about nearly two crankshaft rotations is available to the pistons 9 and 10 as well as to the pressure reservoir piston 29; this is about 30 times as long as the injection lasts maximally. By reason of these comparatively long return periods which are available, the pressure spaces may be connected with each other by means of pressure equalization throttles (return throttles) which with proper selection and dimensioning exert no significant influence on the injection principle of the valve. The return springs produce the actuating pressure drop for the throttle flow. The return throttle for the pressure reservoir 26 is identical with the branch throttle 32. The return throttles of the pistons 9 and 10 and of the associated pressure spaces are produced in the embodiment according to FIG. 1 by a correspondingly large dimensioning of the clearance between the pistons and the corresponding piston guide surfaces so that an annular gap results. In lieu thereof, the pistons or the piston guidances may be provided with one or with several axially extending fine longitudinal grooves of predetermined cross section. With the grooved construction of the throttles, in contrast to the annular gap throttle, the guidance accuracy of the pistons would not suffer.

Figure 3:
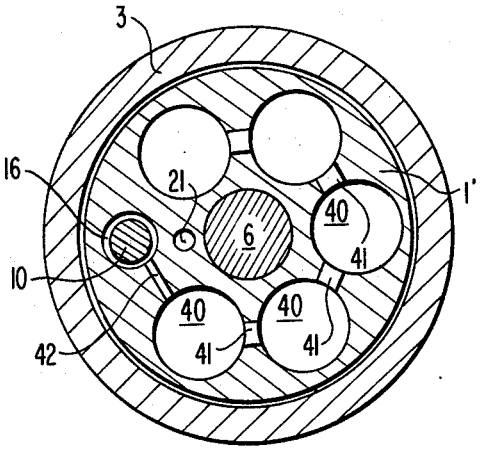
FIG. 3 is a transverse cross-sectional view through the injection valve according to FIG. 2, taken along line III—III of FIG. 2.

The embodiment according to FIGS. 2 and 3 differs from that according to FIG. 1 by the construction of the pressure reservoir as non-yielding volume reservoir 40 which is constituted by several bores closed pressure-tight which are arranged in the nozzle body 1' about the valve needle 6 and are in communication with one another by amply dimensioned lines 41. The volume reservoir is constructed in the illustrated embodiment with its volume about 100 times larger than the oscillating component of the pressure space 16. With these magnitude relationships of the pressure spaces and of the occurring pressures, the inherent elasticity of the fuel liquid can be utilized. This inherent elasticity amounts to about 6.7 pro mil per each 100 atu's. With a pressure of 150 atu's, the liquid therefore compresses by about 1% of its original volume. A volume proportion of this magnitude corresponds approximately to the oscillating proportion of the pressure space 16 and the displaced volume can be received in the spaces 40 by reason of the inherent elasticity of the fuel liquid. This liquid thereby acts similar to a spring or as the gas cushion in an expansion chamber.

The pressure space 16 is in communication with the pressure reservoir 40 by way of a throttle bore 42 which represents at the same time branch line and branch throttle. The throttle 42 is so dimensioned as regards its throttling effect that it causes approximately the same liquid backpressure as the injection openings 2. The pressure stored in the fuel liquid pushes the compressed volume after the injection operation again rapidly back into the space 16 by way of the throttle 42.

In the embodiment according to FIG. 4, the pressure-tight spring space 23 for the valve needle closure spring 22 is utilized as pressure reservoir generally designated by reference numeral 45. For this purpose, the relief connection 24 of the spring space 23 is not, as otherwise, conducted pressureless into the fuel tank. Instead, the spring space 23 is now placed under a slight excess pressure. This excess pressure is produced by the booster pump 46 hydraulically connected ahead of the injection pump 12, whereby the relief line 24 is connected to the pressure connection 47 thereof. Since, however, this pressure is only relatively small, a check valve 50 closing in the branching direction is provided in parallel to the branch throttle 49 arranged in the branch line 48 leading to the spring space 23. This check valve 50 is closed at the beginning of the injection because the return flow is completed. Starting from this closed position of the check valve, the branch quantity displaced by the piston 9' out of the space 16 flows exclusively through the branch throttle 49 so that a pressure corresponding approximately to the injection pressure is being built up in the space 16—by reason of a corresponding dimensioning of the branch throttle. During the return movement of the piston 9' and the refilling of the space 16 out of the spring space 23, the check valve 50 opens and the space 16 can again rapidly fill up also at the relatively slight pressure drop.

In the embodiment illustrated in FIG. 4, the two pistons 9' and 10' are constructed as unitary stepped or differential piston in contrast to the embodiments according to FIGS. 1 to 3. The outlet-side pressure space 17 of the pre-injection piston 10' is in communication with the inlet-side pressure space 15 of the main injection pistion 9' by way of the longitudinal bore 51 and the throttle 52. The throttle 52 is dimensioned so small that it has no significant influence during the short injection period, especially as the pressure drop across the throttle is considerably smaller than the injection pressure itself. But, as should be apparent from FIG. 4, fuel may pass from line 13 through bore 51 and into pressure space 17 via throttle 52 during the relatively long return stroke of the piston, thereby enabling chamber 17 to be refilled.

The outlet-side pressure space 16 of the main injection piston is connected with the inlet-side pressure space 15 thereof also by way of the longitudinal bore 51 and the further throttle 53. The throttle 53 is provided at such a position that it is covered off by the guide surface of the piston when the pre-injection piston 10' moves downwardly and is thereby rendered ineffectual. Exclusively in the illustrated rest position, wherein lines 13 and 24 are in communication via throttle 53, a pressure equalization can take place across the same.

While I have shown and described several embodiments in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

I claim:

1. A fuel injection valve for internal combustion engines, comprising valve housing means provided with discharge opening means, a valve needle means actuatable in the closing direction by a valve needle closure spring and in the opening direction by the pressure of the fed fuel, a pressure space means formed together with the valve housing means and receiving the valve needle means, said pressure space means being operable to be closed against the outside by a valve seat means for the valve needle means and formed by said housing means, said discharge opening means being located downstream of said valve seat means and representing a predetermined flow resistance, at least two piston means kinematically operatively coupled with one another in at least one direction of movement, said piston means being reciprocable between two axial positions, pressure space means on the inlet-side and outlet-side of the piston means, a return spring positioned on the outlet side of said piston, said piston means being actuatable on the inlet-side thereof by the pressure of the supplied fuel and on the outlet-side also by said return spring, a first essentially unobstructed line connection means operatively connecting the outlet-side piston pressure space means of one of the piston means with the pressure space means of the valve needle means, control edge means defining the axial end of a hollow housing space means open to the piston slide surface of the other piston means, said control edge means being axially offset by a predetermined distance from the inlet-side axial position of the other piston means and being operable to be covered by the other piston means, and a second essentially unobstructed line connection means from the hollow housing space means to the pressure space means of the valve needle means, characterized in that said fuel injection valve is further provided with a reservoir means and a connecting line having a predetermined throttling means for achieving a throttling resistance which is greater than that which exists in said first and second unobstructed connecting line means, and wherein the outlet-side pressure space means of the other piston means is operatively connected with the reservoir means by way of said connecting line means having said predetermined throttling means.

2. An injection valve according to claim 1, characterized in that the outlet-side pressure space means of the other piston means is operatively connected with the reservoir means by way of the throttled line means.

3. An injection valve according to claim 1, characterized in that the two piston means are arranged pairwise essentially coaxially to one another.

4. An injection valve according to claim 1, characterized in that said pressure space means on the inlet and outlet side of said piston means is formed by the piston means together with the piston slide surface means and the housing means.

5. An injection valve according to claim 1, characterized in that the reservoir means includes means applying pressure thereto.

6. An injection valve according to claim 5, characterized in that the means applying pressure to said reservoir means is a spring-loaded piston displaceably guided sealingly within a bore.

7. An injection valve according to claim 5, characterized in that the pressure reservoir is constructed as pressure-tight vessel means of essentially constant volume whose volume corresponds at least $k$ times the oscillating volume of the outlet-side pressure space means of the other piston means forming main injection piston means, whereby $k$ is determined from the reciprocal of the compressibility of the fuel liquid divided by the means pressure value of the starting step of the injection operation.

8. An injection valve according to claim 7, in which the pressure reservoir means is constructed as a plurality of pressure-tight vessel means hydraulically essentially unobstructedly connected with each other.

9. An injection valve according to claim 1, with a substantially pressure-tight spring space means for the valve needle closure spring as well as with a line connection to said spring space means, with an injection pump building up the injection pressure, and with a booster pump for the injection pump, characterized in that the spring space means is used as reservoir space means and in that the line connection to the spring space means is connected with the pressure side of the booster pump.

10. An injection valve according to claim 1, characterized in that the throttling effect of the throttling means is approximately equal to that of the discharge opening means of the injection valve.

11. An injection valve according to claim 10, characterized in that a check valve means is arranged hydraulically in parallel to the throttling means, said check valve means closing in the direction toward the reservoir means.

12. An injection valve according to claim 11, characterized in that the throttlng means is installed into the check valve means.

13. An injection valve according to claim 12, with a substantially pressure-tight spring space means for the valve needle closure spring as well as with a line connection to said spring space means, with an injection pump building up the injection pressure, and with a booster pump for the injection pump, characterized in that the spring space means is used as reservoir space means and in that the line connection to the spring space means is connected with the pressure side of the booster pump.

14. An injection valve according to claim 10, characterized in that oppositely disposed ends of the piston means are connected with each other by said throttling means, which throttling means is a pressure equalization means.

15. An injection valve according to claim 14, characterized in that the pressure equalization throttle means is constituted by a corresponding dimension of the clearance between the piston means and the piston slide surface means.

16. An injection valve according to claim 14, characterized in that means for adjusting the inlet-side axial position of the other piston means is provided.

17. An injection valve according to claim 16, characterized in that the means for adjusting is provided by an abutment pin.

18. An injection valve according to claim 1, characterized in that oppositely disposed ends of the piston means are connected with each other by said throttling means, which throttling means serves as a pressure equalization means.

19. An injection valve according to claim 18, characterized in that the throttling means is constituted by a corresponding dimension of the clearance between the piston means and the piston slide surface means.

20. An injection valve according to claim 19, characterized in that means for adjusting the inlet-side axial position of the other piston means is provided.

21. An injection valve according to claim 20, characterized in that the means for adjusting is provided by an abutment pin.

22. An injection valve according to claim 18, characterized in that the two piston means are arranged pairwise essentially coaxially to one another.

23. An injection valve according to claim 21, characterized in that said piston means form said pressure space means each on the inlet and outlet side thereof together with the piston slide surface means and the housing means.

24. An injection valve according to claim 21, characterized in that the reservoir means includes means applying pressure thereto.

25. An injection valve according to claim 21, characterized in that the means applying pressure to said reservoir means is a spring-loaded piston displaceably guided sealingly within a bore.

26. An injection valve according to claim 24, characterized in that the pressure reservoir is constructed as pressure-tight vessel means of essentially constant volume whose volume corresponds at least $k$ times the oscillating volume of the outlet-side pressure space means of the other piston means forming main injection piston means, whereby $k$ is determined from the reciprocal of the compressibility of the fuel liquid divided by the mean pressure value of the starting step of the injection operation.

27. A fuel injection valve for internal combusion engines, comprising housing means provided with discharge opening means and forming a valve seat means upstream of the discharge openings, a valve needle means forming with said valve housing means a pressure space operable to be closed off against the outside by abutment of the valve needle means at the valve seat means, spring means biasing said valve needle means in the closing direction, said needle valve means being operable to the displaced in the opening direction by the pressure of the supplied fuel, said discharge opening means being sized to provide a predetermined flow resistance, at least two piston means kinematically operatively connected with each other in at least one direction of movement, said piston means being reciprocable within corresponding piston bores provided with slide surface means, pressure space means being provided on the inlet-side and outlet-side of the piston means, the inlet side pressure space means of one piston means being adapted to be operatively connected with the pressure side of an injection pump, the outlet-side pressure space means of the other piston means being operatively connected with the pressure space means formed by the needle valve means, further connecting means including a hollow space about said one piston means terminating in the slide surface means for the one piston means and valved by the latter, pressure space means formed by the needle valve means being operatively connected with the hollow space about said one piston means, and said one piston means enabling a direct communication between the inlet-side pressure space means thereof and said further connecting means upon predetermined axial displacement of said one piston means in the direction caused by the pressure of the supplied fuel, characterized by additional means for providing the outlet-side pressure space means of said one piston means with a discharge path having approximately the same flow resistance as the discharge opening means and for enabling a two-step injection operation essentially without interruption and always injecting two clearly different injection quantities independently of load and rotational speed fluctuations.

28. An injection valve according to claim 27, wherein said additional means includes throttling means and a reservoir means operatively connected with the outlet side pressure space means of the one piston means by way of said throttling means, said throttling means providing approximately the same flow resistance as the flow resistance provided by the discharge opening means.

29. A fuel injection valve for internal combustion engines, comprising valve housing means provided with discharge opening means, a valve needle means, resilient means biasing said valve means in a closing direction and said valve needle means being openable under action of the pressure of a fed fuel, a pressure space means formed in said valve housing means and receiving the valve needle means, said pressure space means being operable to be closed against the outside by a valve seat means for the valve needle means and formed by said housing means, said discharge opening means being located downstream of said valve seat means and representing a predetermined flow resistance, at least two piston means kinematically operatively coupled with one another in at least one direction of movement, said piston means being reciprocable between two axial positions, pressure space means on the inlet-side and outlet-side of the piston means, said piston means being actuatable on the inlet-side thereof by the pressure of the supplied fuel and on the outlet-side by a return spring, the outlet-side piston pressure space means of at least one of the piston means being in communication with the pressure space means of the valve needle means, and a hollow housing space means, said hollow housing space being in communication with the pressure space means of the valve needle means, characterized in that said fuel injection valve is further provided with a reservoir means and a connecting line having a throttling means, and wherein the outlet-side pressure space means of the other piston means is operatively connected with the reservoir means by way of said connecting line means having said predetermined throttling means, said throttling means having a throttling effect that is approximately equal to that of the discharge opening.

30. In a fuel injection valve of the type having a valve housing provided with a nozzle means having a discharge opening means, said discharge opening means having a predetermined flow resistance, closure means for said discharge opening operable to an open position under the pressure influence of a fed fuel and resiliently biased toward a closed position, means for producing two fluid flows following one after another in time and differing in their volume per unit time by volume-influenced fluid separation including at least two piston means kinematically operatively coupled with one another in at least one direction of movement, and pressure space means on the inlet-side and the outlet side of the piston means, said piston means being actuatable on the inlet-side thereof by the pressure of fuel supplied thereto, said inlet side pressure space being adapted to be connected with the pressure side of an injection pump and said outlet side pressure space being operatively connected to said nozzle means, the improvement comprising:

additional means for simulating to the outlet-side pressure space means a discharge path offering approximately the same flow resistance as that of the discharge opening means to provide a two-step injection operation essentially without interruption.

31. An injection valve according to claim 30, wherein said additional means includes throttling means and a reservoir means operatively connected with the outlet side pressure space means of the piston means by way of said throttling means, said throttling means providing approximately the same flow resistance as the flow resistance provided by the discharge opening means.

32. An injection valve according to claim 31, characterized in that the reservoir means includes means applying pressure thereto.

33. An injection valve according to claim 32, characterized in that the means applying pressure to said reservoir means is a spring-loaded piston displaceably guided sealingly within a bore.

34. An injection valve according to claim 31, characterized in that the reservoir is constructed as pressure-tight vessel means of essentially constant volume whose volume corresponds at least $k$ times the oscillating volume of the outlet-side pressure space means of the piston means forming main injection piston means, whereby $k$ is determined from the reciprocal of the compressibility of the fuel liquid divided by the mean pressure value of the starting step of the injection operation.

* * * * *